US006397035B2

(12) United States Patent
Kataoka et al.

(10) Patent No.: US 6,397,035 B2
(45) **Date of Patent: *May 28, 2002**

(54) IMAGE FORMING APPARATUS WITH CONTROL OF CONVEYING SPEEDS

(75) Inventors: Tatsuhito Kataoka; Kazuhiko Hirooka; Yoshihiro Funamizu, all of Numazu; Katsumi Takahashi, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/416,949

(22) Filed: Oct. 13, 1999

(30) Foreign Application Priority Data

Oct. 16, 1998 (JP) ..... 10-295874

(51) Int. Cl.[7] ..... G03G 15/00
(52) U.S. Cl. ..... 399/388; 399/394; 399/396
(58) Field of Search ..... 399/16, 388, 393, 399/394, 396, 23, 390; 271/3, 17

(56) References Cited

U.S. PATENT DOCUMENTS

| | | | | |
|---|---|---|---|---|
| 4,597,660 A | | 7/1986 | Leng et al. | |
| 4,796,035 A | | 1/1989 | Kawasaki et al. | 346/108 |
| 5,119,146 A | * | 6/1992 | Nobumori et al. | 399/396 |
| 5,290,024 A | | 3/1994 | Takahashi | 271/122 |
| 5,474,287 A | | 12/1995 | Takahashi | 271/10.13 |
| 5,482,265 A | | 1/1996 | Nakazato et al. | 271/242 |
| 5,831,744 A | | 11/1998 | Kataoka | 358/296 |
| 5,909,872 A | | 6/1999 | Takahashi | 271/116 |

FOREIGN PATENT DOCUMENTS

| | | |
|---|---|---|
| JP | 59-24870 | 2/1984 |
| JP | 63-001645 | 1/1988 |
| JP | 4-235848 | 6/1992 |
| JP | 4-337748 | 11/1992 |
| JP | 06-255838 | 9/1994 |
| JP | 8-225166 | 9/1996 |

* cited by examiner

*Primary Examiner*—William J. Royer
(74) *Attorney, Agent, or Firm*—Fitzpatrick, Cella, Harper & Scinto

(57) ABSTRACT

An image forming apparatus is provided with a sheet support on which sheets are supported thereon, a sheet feeding unit for feeding the sheets from the sheet support, a first conveying unit for conveying the sheets fed by the sheet feeding unit to the vicinity of an image forming device for forming images on the sheets, a second conveying unit for feeding the sheets conveyed by the first conveying unit to the image forming device so as to be cable of forming images thereon, and a control for controlling the sheet conveying speed of the sheet feeding unit, the first conveying unit and the second conveying unit, and the control controls so that the sheet conveying speed may become higher in the order of the sheet feeding unit, the second conveying unit and the first conveying unit.

19 Claims, 7 Drawing Sheets

IMAGE FORMING APPARATUS WITH CONTROL OF CONVEYING SPEEDS

BACKGROUND OF THE INVENTION

1. Field of the Invention

This invention relates to an image forming apparatus such as an electrophotographic type analog-digital copying machine, a color copying machine, a printer or a page printer.

2. Related Background Art

When image formation is to be done at a high speed, for example, in an electrophotographic type image forming apparatus, the image forming speed thereof has been realized by effecting, in addition to the supply and conveyance of transfer paper which is a sheet, an image forming process, i.e., a series of operations such as latent image formation, development, the transfer of a toner image to a transfer sheet and fixing at a high speed. For example, to realize an image forming apparatus capable of forming 60 sheets of images per minute in contrast with an image forming apparatus capable of forming 30 sheets of images per minute, the driving speed necessary for the image forming process, in addition to the supply and conveyance of the transfer sheet, has been set to two times.

In the above-described example of the prior art, however, in order to realize high-speed image formation, it has been required to effect the image forming process at a high speed, in addition to the conveyance of the transfer sheet, and large-scaled studies have been required.

Thus, for example, in the latent image formation in the image forming process, it is necessary in a digital image forming apparatus to operate image processing and latent image forming means such as a laser at a high speed, and when for example, development from an image forming apparatus capable of forming 30 sheets of images per minute to an image forming apparatus capable of forming 60 sheets of images per minute is to be done, the image processing portion or the like in which the image clock frequency thereof has been made double has been required.

Also, in an analog image forming apparatus, it has been necessary to double the driving speed of an original scanner for scanning an original to be copied.

Further, in both apparatuses, the image forming process such as the development and transfer of a toner image is, as it were, the most important technique in an electrophotographic type image forming apparatus, and a long study time has been required until the constructing and technique thereof are determined, and a great deal of resources have been required for the development of an image forming apparatus accompanying high-speed image formation.

SUMMARY OF THE INVENTION

The present invention has as its object to provide an image forming apparatus of high image forming efficiency and high productivity which narrows the interval between sheets fed to an image forming portion, without changing the image forming process speed.

The image forming apparatus of the present invention is provided with sheet supporting means on which sheets are supported, sheet feeding means for feeding said sheets from said sheet supporting means, sheet conveying means for conveying said sheets fed by said sheet feeding means to the vicinity of image forming means for forming images on said sheets, image forming and conveying means for conveying said sheets conveyed by said sheet conveying means into said image forming means for image formation, and control means for controlling the sheet conveying speeds of said sheet feeding means, said sheet conveying means and said image forming and conveying means, said control means being adapted to control so that the sheet conveying speed may become higher in the order of said sheet feeding means, said image forming and conveying means and said sheet conveying means.

In the above-described image forming apparatus of the present invention, the control means controls so that the sheet conveying speed may become higher in the order of the sheet feeding means, the image forming and conveying means and the sheet conveying means and therefore, the sheets are slowly and reliably supplied from the sheet supporting means, and are rapidly conveyed to the vicinity of the image forming means to thereby shorten the conveying time, whereafter the sheets are slowly conveyed and images are reliably formed on the sheets by the image forming means.

Therefore, the image forming apparatus can be made high in speed without changing the image forming process speed.

The image forming apparatus of the present invention is such that said control means controls said sheet feeding means so that the sheet conveying speed may continuously or stepwisely increase from the sheet stopped state to a predetermined sheet conveying speed.

The image forming apparatus of the present invention is such that said sheet feeding means, said sheet conveying means and said image forming and conveying means are provided with individual drive sources.

The image forming apparatus of the present invention is such that since the drive sources of said sheet feeding means, said sheet conveying means and said image forming and conveying means are individual, the control of each means by the control means becomes easy.

The image forming apparatus of the present invention is such that said sheet conveying speed is a speed at which the sheet is conveyed when said drive sources have assumed their constant operative states from their started states.

DETAILED DESCRIPTION OF THE PREFERRED EMBODIMENT

An embodiment of the present invention will hereinafter be described with reference to the drawings.

Figure 1:
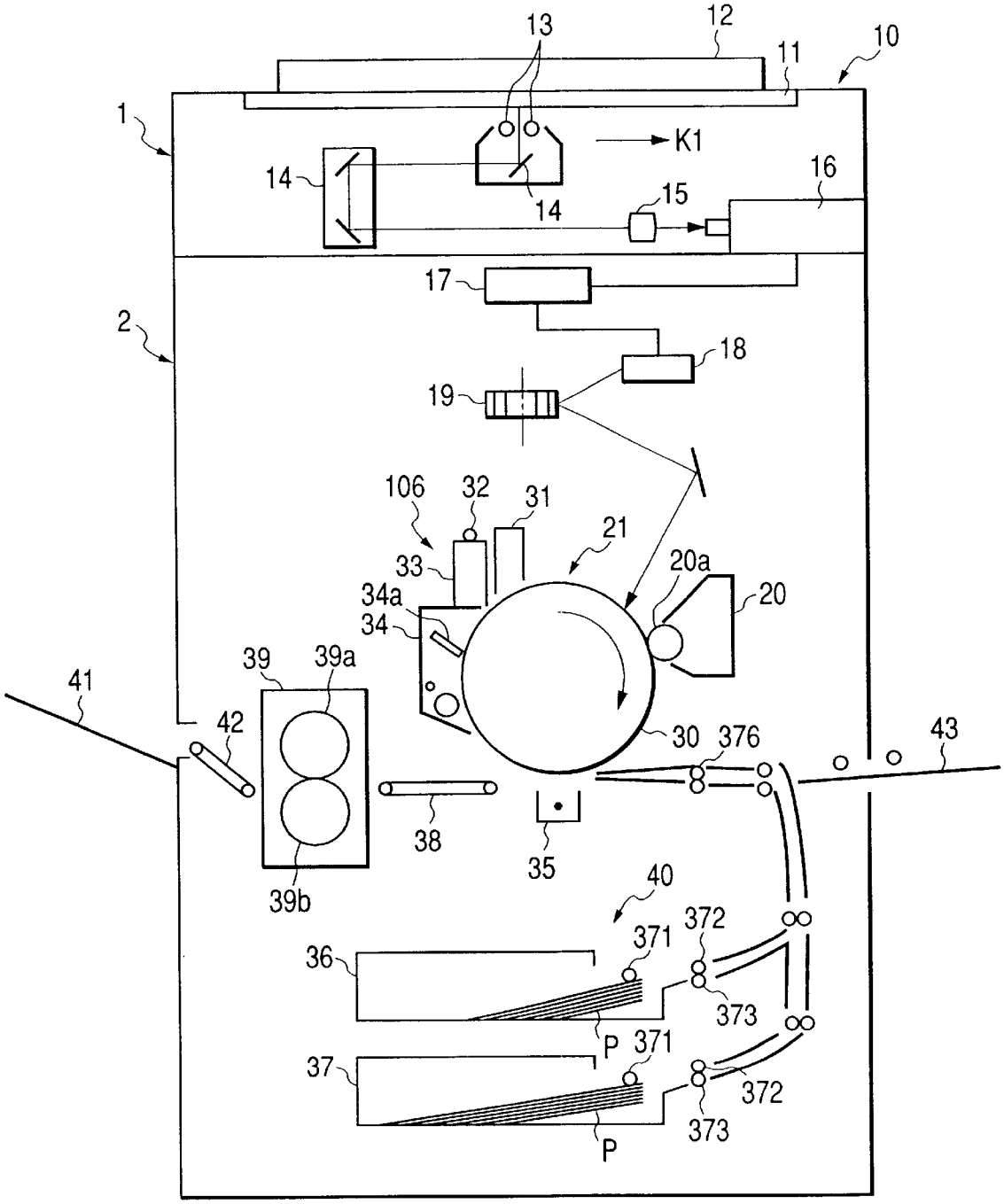
FIG. 1 is a schematic front cross-sectional view of a digital copying machine which is an image forming apparatus according to an embodiment of the present invention.

FIG. 1 shows a schematic front cross-sectional view of a digital copying machine which is an embodiment of an image forming apparatus according to the present invention.

Sheets include paper, thin sheets which are substitutes for paper, etc., but in the copying machine of the present embodiment, a sheet on which an image is formed is referred to as the "original", and a sheet on which an image is to be formed is referred to as the "transfer sheet".

The digital copying machine 10 is provided with a reader portion 1 in the upper portion thereof, and a printer portion 2 in the lower portion thereof.

The reader portion 1 is comprised chiefly of an original supporting table 11 on which an original is supported, an original pressing plate 12 for pressing the original supported on the original supporting table 11 from above it, a light source 13 for irradiating the image bearing surface of the original, a plurality of mirrors 14, 14 and a lens 15 for directing the reflected light from the image bearing surface of the original, and an image processing portion 16 which is a photoelectric converting portion having the function of photoelectrically converting the reflected light by a CCD, and effecting various kinds of image processing on an electrical signal thus obtained.

The image processing portion 16 has a CCD, not shown, and image processing functions such as A/D conversion, S/H, shading correction, masking correction, focal length changing and LOG conversion.

The operation of the reader portion 1 will now be described.

An original is placed on the original supporting table 11 so that the image bearing surface thereof may face downwardly, and the original is held down from above it by the original pressing plate 12. The light source is moved in the direction of arrow K1 while applying light, and scans the image bearing surface of the original. The reflected light image from the image bearing surface is formed on a CCD as a line image sensor through the intermediary of the plurality of mirrors 14 and the lens 15, and is photoelectrically converted into an electrical signal there.

The image signal which has become an electrical signal is subjected to various kinds of image processing in the image processing portion 16, and is transmitted to the next printer portion 2.

The printer portion 2, as shown in FIG. 1, is comprised chiefly of an image control portion 17 for converting the electrical signal sent thereto from the reader portion 1 into a signal for driving a laser, a laser element 18, a polygon scanner 19 for scanning the surface of a photosensitive drum 30 which will be described later by a laser beam, an image forming portion 21 including the photosensitive drum 30 which will be described later, and a fixing unit 39 disposed at the most downstream side.

The above-described image forming portion 21 is comprised chiefly of the photosensitive drum 30 supported for rotation in the direction of arrow, a primary charger 31 for uniformly charging the surface of the photosensitive drum 30, a developing device 20 for developing an electrostatic latent image on the photosensitive drum 30, a transfer charger 35 for transferring a toner image on the photosensitive drum 30 to transfer sheet P, a cleaner 34 for removing any untransferred toner adhering to the photosensitive drum 30, a cleaner blade 34*a* in the cleaner 34 for scraping off the untransferred toner adhering to the photosensitive drum 30, an auxiliary charger 33 for effecting the removal of charges, and a pre-exposure lamp 32 for removing any residual charges which are substantially successively disposed around the photosensitive drum 30 along the direction of rotation thereof.

Further, a developing roller 20*a* is disposed in the developing device 20. This developing roller 20*a* is adapted to be rotated in a direction opposite to the direction of rotation of the photosensitive drum 30 to thereby develop the toner image on the photosensitive drum 30.

The transfer paper P which is a sheet to which the toner image has been transferred is conveyed to the fixing unit 39 by a pre-fixing conveying belt 38, and there fixing rollers 39*a* and 39*b* are rotated and convey the transfer paper P, whereby the transfer paper P is pressed and the toner image on the surface thereof is heated and pressed and is fixed thereby. Finally, after the fixing, the transfer sheet P is discharged onto a sheet discharge tray 41 outside the main body of the copying machine by a post-fixing conveying belt 42.

A supply conveying portion for effecting the supply and conveyance of the transfer paper P has a conveying path for the transfer sheet P, and is comprised of main parts such as an upper sheet supply cassette 36, a lower sheet supply cassette 37, a sheet feeding device having a sheet feeding roller and a conveying roller, and a multi-sheet feeding device 43 at the most upstream side with respect to the direction of conveyance of the transfer sheet P.

From this multi-sheet feeding device 43, various transfer sheets differing in the qualities of transfer sheet such as material and size can be supplied to the image forming portion 21 because the transfer sheet feeding path thereof is straight.

Figure 2:
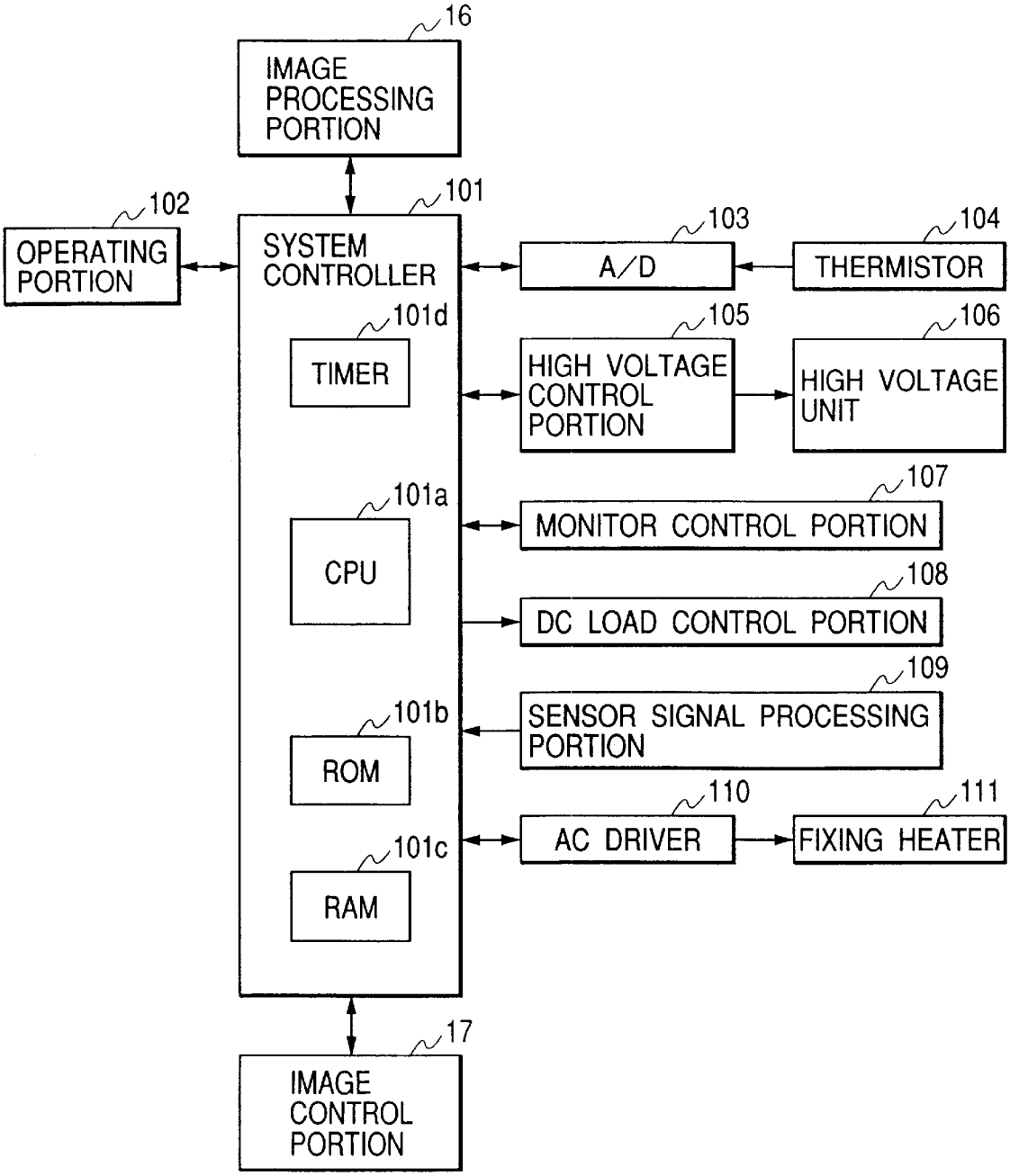
FIG. 2 is a block diagram showing an example of the control system of the copying machine of FIG. 1.

FIG. 2 shows a block diagram of the control system of the digital copying machine 10.

The copying machine 10 is adapted to be generally controlled by a system controller 101. Accordingly, the system controller 101 bears the role of the exchange of data with an operating portion 102, i.e., a user interface, in addition to chiefly the driving of each load in the copying machine 10, the collection and analysis of the information of sensors, and the aforedescribed image processing portion 16 and image control portion 17.

In the system controller 101, a CPU 101*a* is carried to bear the above-described role. The CPU 101*a* executes various sequences about an image forming sequence predetermined by a program stored in a ROM 101*b* likewise carried in the system controller 101. Also, there is carried a RAM 101*c* storing therein rewritable data which need be primarily or permanently preserved at that time. Design is made such that for example, a high voltage set value to a high voltage control portion 105 which will be described later, various kinds of data which will be described later, and image forming command information or the like from the operating portion 102 are stored in the RAM 101*c*. Timers such as a delay timer, a sheet supply timer, a pre-registration timer and a judgement timer are present in the CPU 101*a*. The control such as the detection and setting of the count numbers of these timers is effected by a timer portion 101*d*.

Description will now be made of the data exchange with the image processing portion 16, the image control portion 17 and the operating portion 102 which is a first role of the system controller 101.

The system controller 101, as previously described, cooperates with the image processing portion 16 to execute image processings such as the A/D conversion of the image signal from the CCD, not shown, S/H, shading correction, masking correction, focal length changing and LOG conversion. The system controller 101 delivers the specification setting value data of each portion necessary for these image processings and in addition, receives a signal from each portion, for example, an original image density signal or the like, and controls the high voltage control portion 105 and the image control portion 17 which will be described later to thereby effect setting for effecting optimum image formation.

The system controller 101 cooperates with the image control portion 17 to effect the prescription of the image size for forming an image, and the setting necessary to optimally control the laser, i.e., to PWM-process the light emission of the laser in the copying machine, on the basis of image-processed digital video data.

The system controller 101 cooperates with the operating portion 102 to obtain information such as a copying magnification set by the user and the density set value and in addition, delivers information regarding the state of the copying machine, for example, the number of sheets of formed images and whether the image formation is going on, and data or the like for showing the occurrence of jam and the location thereof to the user.

Description will now be made of the driving of each load in the copying machine and the collection and analysis of the information of sensors which are a second role of the system controller 101.

A motor, DC loads such as a clutch/solenoid, and sensors such as a photointerrupter and microswitches are disposed at various locations in the copying machine 10. That is, the system controller 101 suitably drives the motor and each DC load to thereby effect the conveyance of the transfer paper and the drive control of each unit, and the various sensors monitor the operations thereof. So, the system controller 101 controls each motor by a motor control portion 107 on the basis of a signal from a sensor signal processing portion 109 connected to the various sensors and at the same time, operates the clutch/solenoid by a DC load control portion 108 to thereby forward the image forming operation smoothly. Also, the system controller 101 delivers various high voltage control signals to the high voltage control portion 105 to thereby apply appropriate high voltages to the primary charger 31, the auxiliary charger 33, the transfer charger 35 and the developing roller 20*a* which are various chargers constituting a high voltage unit 106.

Further, fixing heaters 111 for heating the fixing rollers 39*a* and 39*b* in the aforedescribed fixing unit 39 are contained in the fixing rollers 39*a* and 39*b*, and the heaters are ON/OFF-controlled by an AC driver 110. Also, each of the fixing rollers 39*a* and 39*b* is provided with a thermistor 104 for measuring the temperature thereof at that time, and a change in the resistance value of the thermistor 104 conforming to a change in the temperature of each of the fixing rollers 39*a* and 39*b* is converted into a voltage value by A/D 103, whereafter it is inputted as a digital value to the system controller 101. The aforedescribed AC driver 110 is controlled on the basis of this temperature data.

Figure 3:
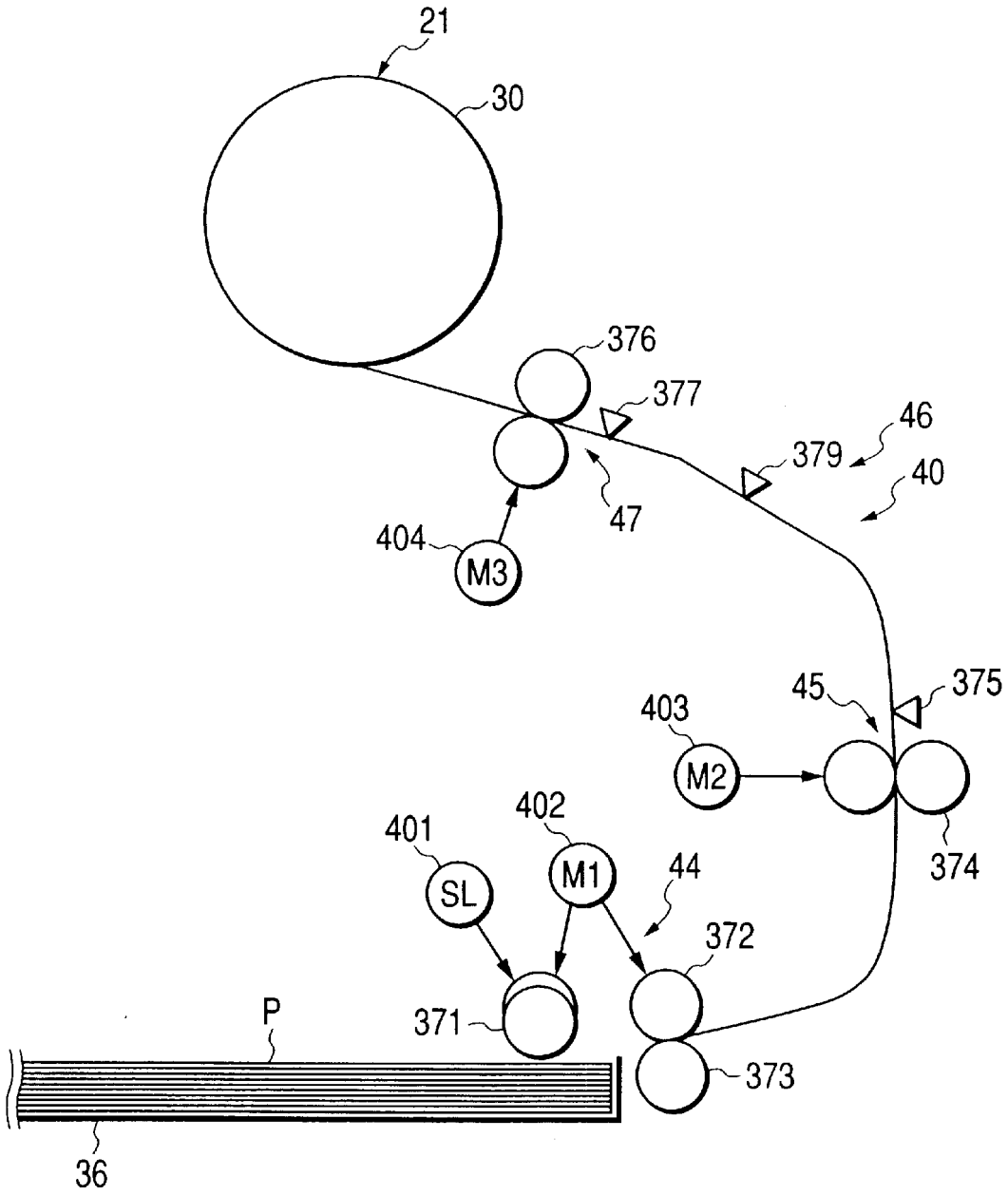
FIG. 3 is a schematic view of a portion for conveying a sheet from a cassette to the transfer position of a photosensitive drum.

Reference is now had to FIG. 3 to describe the sheet supply and conveying portion 40 for supplying and conveying the transfer sheet P to the transfer position of the photosensitive drum 30 in the printer portion 2.

The sheet supply and conveying portion 40 is comprised of a sheet supplying portion 44, a pre-registration correcting portion 45, an inter-sheet judging portion 46 and a main registration correcting portion 47.

The sheet supplying portion 44 is comprised of an A roller 371 for picking up transfer sheets one by one from a cassette 36 containing transfer sheets therein (here, the upper cassette is described, but a similar operation is also performed on the lower sheet supply cassette 37), a B roller 372 and a C roller 373 for separating the picked-up transfer sheets one by one.

The pre-registration correcting portion 45 is comprised of a pre-registration roller 374 for taking the pre-registration of the transfer sheet P separated by the B roller 372 and the C roller 373, and a pre-registration sensor 375 used for the control of the pre-registration roller.

The inter-sheet judging portion 46 is provided with a judgement sensor 379 for detecting the interval between the transfer sheets when the transfer sheets P are continuously supplied.

The main registration correcting portion 47 is comprised of registration rollers 376 taking the registration of the transfer sheet when the image developed on the surface of the drum is transferred to the transfer sheet, and a registration sensor 377 for detecting the arrival of the transfer sheet P at the registration rollers 376.

Also, in the present copying machine, a first drive source for driving the A, B and C rollers 371, 372 and 373 for pulling the transfer sheet P out of the cassette 36, a second drive source for driving the pre-registration roller 374 of the pre-registration correcting portion 45 for conveying the transfer sheet P, and a third drive source for driving the registration rollers 376 of the main registration correcting portion 47 are comprised of independent drive sources, respectively, and in the present embodiment, they are driven by DC motors M1 (402), M2 (403) and M3 (404), respectively.

The conveyance speed of the transfer sheet P, i.e., the number of revolutions of the motor M3 (404), when the registration rollers 376 of the main registration correcting portion 47 are being steadily rotated, is controlled so as to become the same as the speed of the image forming process (development and transfer).

Also, the conveyance speed of the transfer sheet P, i.e., the rotational speed of the motor M2 (403), when the pre-registration roller 374 of the pre-registration correcting portion 45 is being steadily rotated is controlled so as to be a rotational speed higher than the rotational speed of the above-described motor M3 (404) and the rotational speed of the motor M1 (402) which will be described later.

This is for making the conveying speed of the sheet supplying portion 44 which will be described later lower than the image forming process speed to improve the sheet supply accuracy of the sheet supplying portion 44, and recovering the lowered conveying speed to thereby set the interval between the transfer sheets P when the image forming process is carried out shortly.

For example, in a copying machine of a certain image forming process speed, as compared with a case where the above-described control is not effected, when the above-described control is effected, the interval between the transfer sheets P can be shortened and at the same, the accurate supply of the transfer sheets P becomes possible and as the result, the productivity as the copying machine can be enhanced.

The sheet supplying portion 44 will be described in greater detail with reference to FIG. 4. The sheet supplying portion 44 is comprised of a sheet supply pickup portion and a separating and conveying portion.

The sheet supplying portion 44 is a portion for supplying the transfer sheet P from the cassette 36 containing the transfer sheets P therein by the A roller 371 for picking up the transfer sheets P one by one. This A roller 371 is vertically moved in conformity with predetermined sheet supply interval timing to thereby pick up the transfer sheets. This interval timing is set to a one-second interval in a copying machine capable of forming 60 sheets of images per minute. In the present copying machine, the A roller 371 is vertically moved by a solenoid 401.

Description will now be made of a separating mechanism portion for separating the picked up transfer sheets one by one. This separating mechanism portion is a portion for conveying the transfer sheets picked up by the A roller 371 one by one by the B roller 372 and the C roller 373 opposed to each other in FIG. 4 being rotated. Also, when a plurality of transfer sheets have been picked up by the A roller 371, the C roller 373 is rotated in the opposite direction (the direction of arrow), whereby the first (upper) transfer sheet and the subsequent (lower) transfer sheets P are checked and separated by the B and C rollers 372 and 373. Here, when the transfer sheet is supplied by the A roller 371, irregularity is created in the amount of overrun by which the transfer sheet P passes between the B and C rollers 372 and 373 for the ON timing of the driving of the A roller 371, depending on the behavior of the first (upper) transfer sheet P and the subsequent (lower) transfer sheets. This irregularity is corrected by the above-described pre-registration correcting portion 47.

Figure 4:
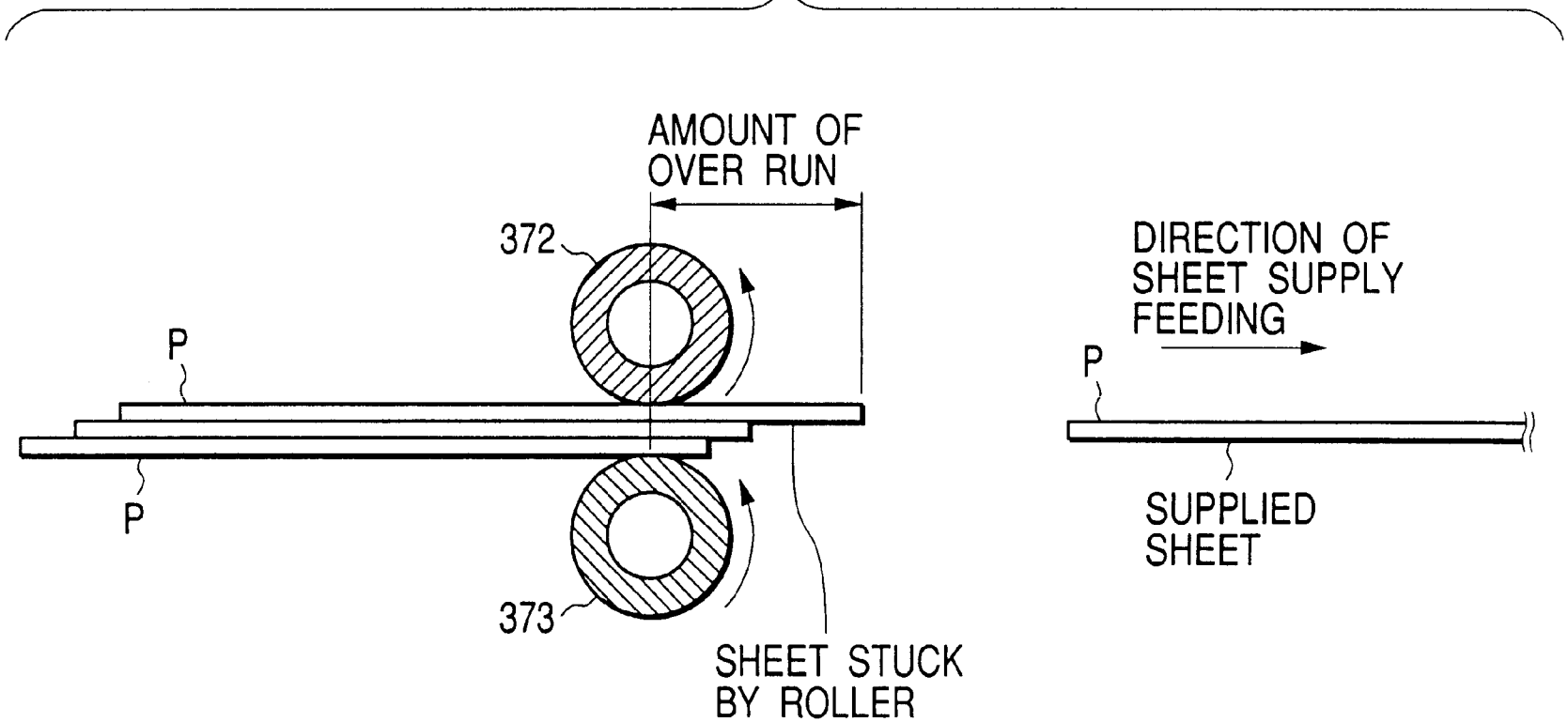
FIG. 4 illustrates a state in which a sheet is fed out of the cassette.

Also, in the present copying machine, in order to suppress the above-mentioned irregularity, the rotational speed of the motor M1 (402) which is the above-described first drive source is made higher to thereby effect stable sheet supply in which the irregularity of the amount of overrun shown in FIG. 4 is small. The conveyance speed of the transfer sheet P, i.e., the rotational speed of the motor M1 (402), when the motor M1 is steadily rotated after its rotational speed has been made higher is controlled so as to become lower than the speed of the image forming process (development and transfer).

As described above, the irregularity of the amount of overrun is further suppressed, that is, conveyance at a low speed is effected at the stage of sheet supply which is the greatest factor of the irregularity of conveyance of the transfer sheets, whereby the accuracy thereof can be improved.

The above-described motors M1, M2 and M3 (402, 403 and 404) are controlled by the motor control portion 107 of FIG. 2 on the basis of the command of the system controller 101. The then conveyance speed of the transfer sheet P is set so as to become higher in the order of the sheet supplying portion 44 (the A, B and C rollers 371, 372 and 373), the main registration correcting portion 47 (the registration rollers 376) and the pre-registration correcting portion 45 (the pre-registration roller 374) by controlling the rotational speed of each motor during the steady rotation thereof. That is, the transfer sheet conveying speed of the pre-registration correcting portion 47 (the registration rollers 376) is the image forming process speed of the present copying machine, and it becomes possible to reliably drive the sheet supplying portion 44 more slowly than the image forming process speed aiming at the improved accuracy of the conveying speed of the sheet supplying portion 44, and thereafter set the conveyance speed of the transfer sheet P until the image forming process is carried out so as to become high to the utmost, and absorb the delay of the sheet supply and at the same time, shorten the interval between the transfer sheets at the image forming process speed. That is, by the main control being carried out, only the interval between the transfer sheets being conveyed is shortened without the image forming process speed being changed, whereby the productivity of image formation is enhanced.

Also, at that time, the signals from the sensors 375, 379 and 377 are inputted to the system controller 101 via the sensor signal processing portion 100, and the system controller generally controls each motor and DC load.

Figure 5A:
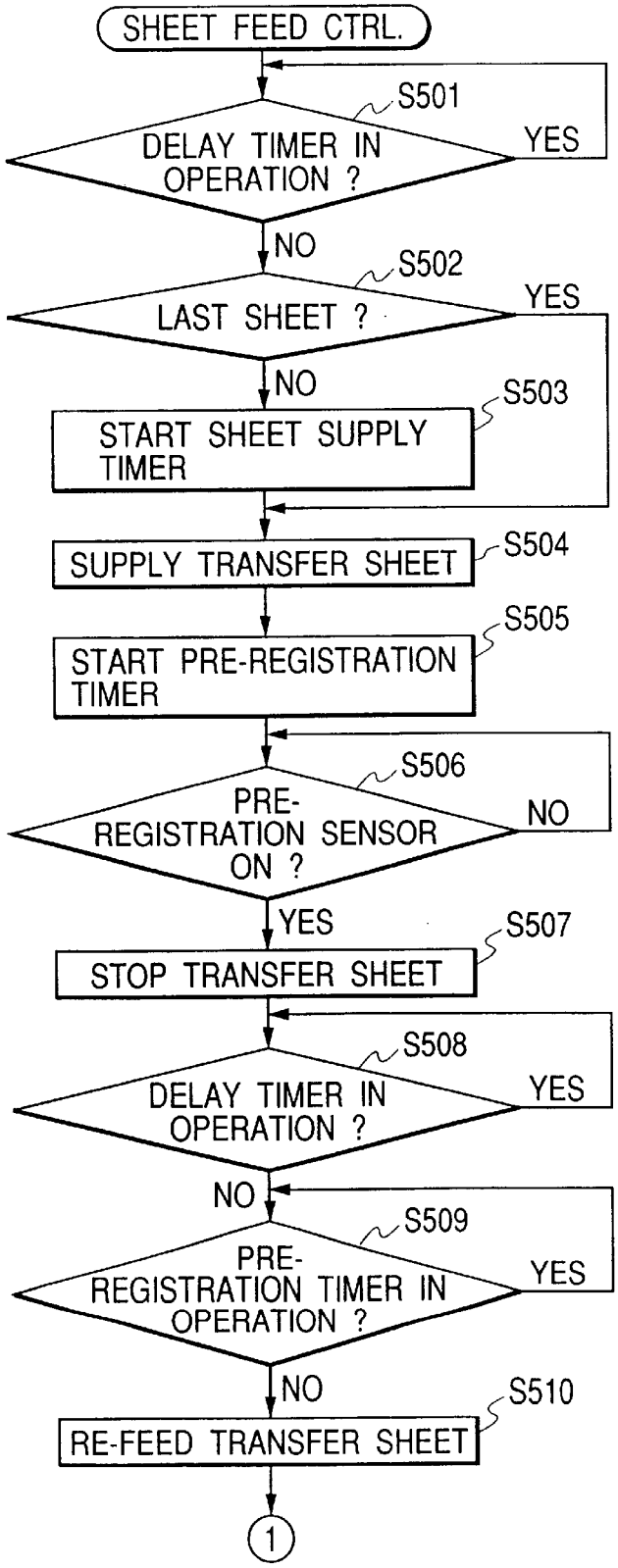
FIGS. 5A and 5B are flow charts showing the control procedure of the controller 101 of the copying machine of FIG. 1.
Figure 5B:
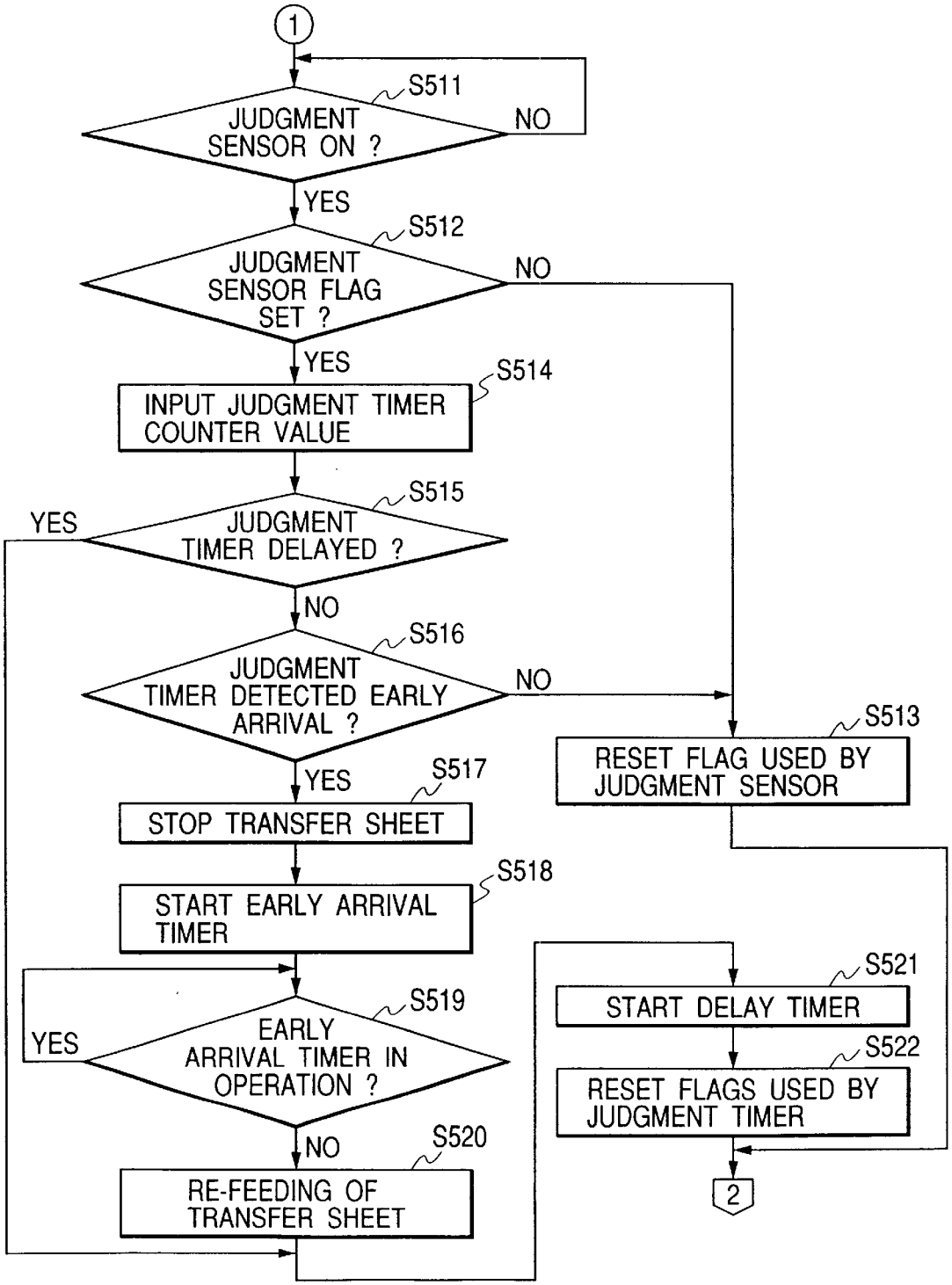
Figure 6:
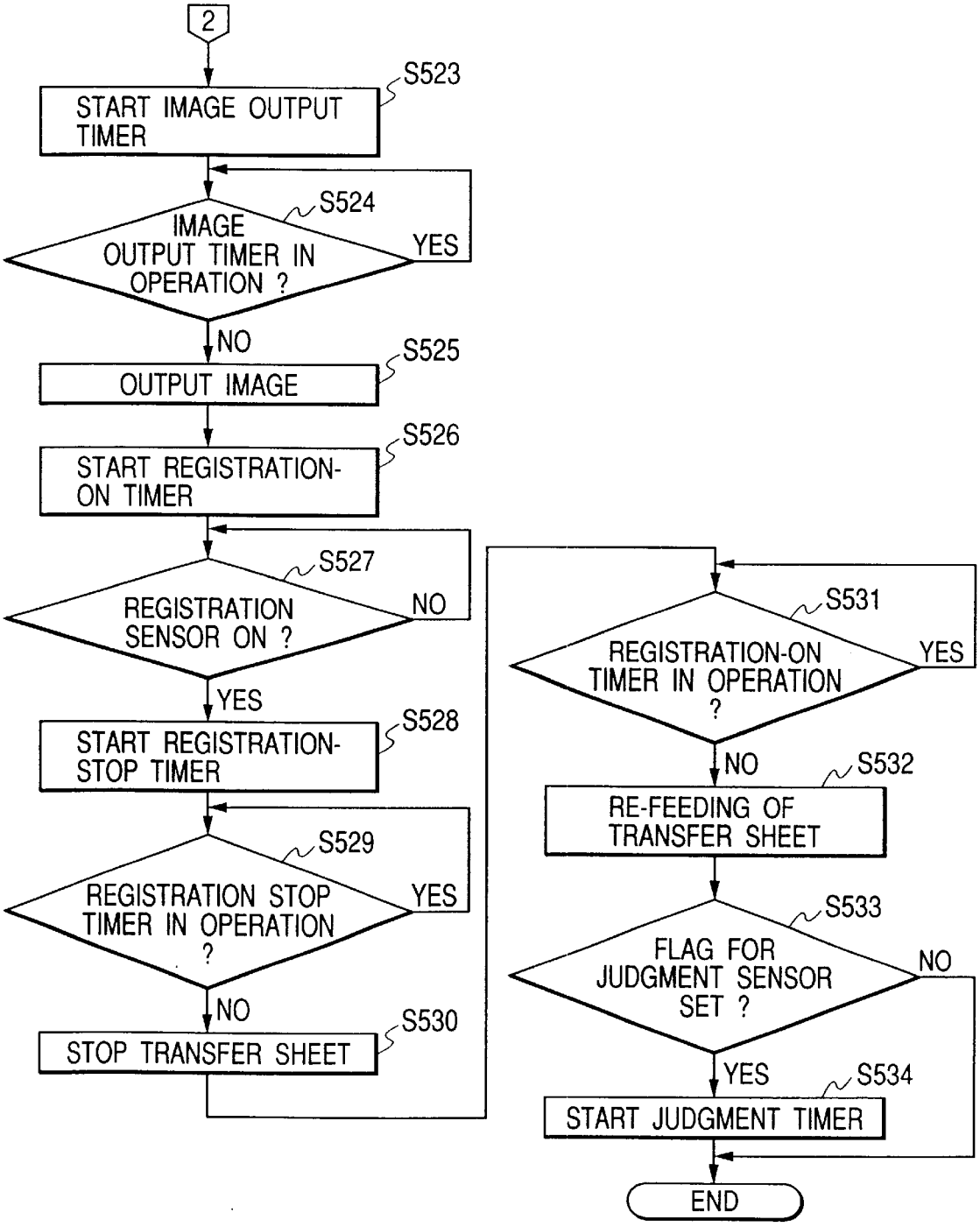
FIG. 6 is a flow chart continued from FIG. 5B showing the control procedure of the controller 101 of the copying machine of FIG. 1.

FIGS. 5A and 5B and FIG. 6 are flow charts showing the control procedure of the controller 101 of the copying machine according to the present invention, and show an example of the feed control of the transfer sheet.

When the sheet feed control is started, if at a step S501, a delay timer which will be described later is counting, the termination of the counting is waited for.

Next, the system controller 101, at a step S502, judges whether the transfer sheet which is about to be fed is the last sheet while the transfer sheets area counted by the CPU 101*a* each time a transfer sheet is fed out of the sheet supply cassette 36, and if it is not the last sheet, at a step S503, the system controller starts a sheet supply timer, not shown, to obtain the timing of the sheet feed control of the next transfer sheet and substantially at the same time, at a step S504, the system controller operates the A roller 371 to thereby feed the transfer sheet.

Next, at a step S505, a pre-registration timer for obtaining the timing for re-conveying the transfer sheet stopped in the pre-registration correcting portion 45 later is started immediately after a transfer sheet has been fed from the sheet supply cassette 36, and at a step S506, the transfer sheet is detected by the pre-registration sensor 375, and at a step S507, the DC motor M2 (403) is stopped to thereby stop the transfer sheet at the pre-registration correcting portion 45, whereafter at a step S508, if the delay timer which will be described later is counting, the termination of the counting is waited for. In the meantime, the transfer sheet is preliminarily registered. Here, the delay timer is set by the sheet feed control of the preceding transfer sheet when the conveyance of the preceding transfer sheet is delayed by a predetermined time or longer, and by the timing of the detection of the delay of the transfer sheet, the control of delaying the sheet feed for the next transfer sheet (the judgement of the step S501) or the control of delaying the re-conveyance from the pre-registration correcting portion 45 (the judgement of the step S508) is effected.

Next, if at a step S509, the pre-registration timer is counting, the termination of the counting is waited for, and at a step S510, the DC motor M2 (403) is operated to thereby re-convey the transfer sheet stopped at the pre-registration correcting portion 45.

Next, when at a step S511, the transfer sheet is detected by the judgement sensor 379, whether a judgement sensor flag is set or not is judged at a step S512, and if it is not set, the judgement sensor flag is set at a step S513, and jump is made to a step S523. The judgement sensor flag is set by the sheet feed control of the preceding sheet when there were not the early arrival and delay of the preceding transfer sheet by a predetermined time or longer relative to the still preceding transfer sheet, and the detection of the delay or early arrival of the next transfer sheet is effected.

When at the step S512, it is judged that the judgement sensor flag is set, the counter value of the judgement timer for detecting the delay and early arrival of the transfer sheet relative to the preceding sheet is inputted at a step S514, and at a step S515, the counter value of the judgement timer is sent to the CPU 101*a*, and the system controller 101 judges whether the transfer sheet is delayed relative to a reference value within a predetermined range (whether the counter value is a value within a predetermined range or greater), and when it is judged to be delayed, jump is made to a step S521.

There are three cases for the start and termination of the counting by the judgement timer, and any of those cases may be used.

A first case is started immediately after the registration rollers 376 have started the conveyance of the preceding transfer sheet, and is terminated when the leading end of the next transfer sheet is detected by the judgement sensor 379.

A second case is started immediately after the registration rollers 376 have completed the conveyance of the preceding transfer sheet, and is terminated when the leading end of the next transfer sheet is detected by the judgement sensor 379.

A third case is started when the leading end of the preceding transfer sheet is detected by the judgement sensor 379, and is terminated when the leading end of the next transfer sheet is detected.

When by the judgement of the step S515, it is judged that delay has not occurred (early arrival or normal arrival), whether the counter value of the judgement timer has early arrival relative to a reference value within a predetermined range (whether the counter value is equal to a value within a predetermined range or less) is judged at a step S516, and when it is judged that it has not arrived early, the judgement sensor flag is set at the step S513, and jump is made to a step S523.

When by the judgement of the step S516, it is judged that the transfer sheet has arrived early, the DC motor M2 (403) is stopped at a step S517 to thereby stop the transfer sheet at the judging portion.

Next, at a step S518, an early arrival timer for stopping and delaying the transfer sheet having arrived early by the timing by which it has arrived early is started, and at a step S519, the early arrival timer is stopped at a point of time whereat the count of the early arrival timer has become substantially the same as the difference between the counter value of the judgement timer and the above-mentioned reference value, and at a step S520, the DC motor M2 (403) is operated to thereby re-convey the transfer sheet.

Next, when at a step S521, the transfer paper has been delayed or has arrived early, the delay timer for delaying the conveyance of the next transfer sheet by a predetermined time is started, and at a step S522, the judgement sensor flag is reset so as not to effect the detection of the delay and early arrival by the judgement sensor 379 for the next transfer sheet.

Next, at a step S523, an image output timer is started to make the conveyance timing of the transfer sheet coincide with the timing of image formation on the photosensitive drum 30, and when at a step S524, the counting by the image output timer is terminated, image formation on the photosensitive drum 30 is effected at a step S525.

Next, when at a step S526, a registration-on timer for obtaining the timing for re-conveying the transfer sheet stopped at the pre-registration correcting portion 45 later is started when the leading end of the transfer sheet has moved to between the judgement sensor 379 and the registration sensor 377. At this time, the DC motor M3 (404) is stopped. When at a step S527, the transfer sheet is detected by the registration sensor 377, a registration stopping timer for the leading end of the transfer sheet to form a predetermined loop at the registration rollers 376 and be stopped is started at a step S528, and when at a step S529, the counting by the registration stopping timer is terminated, the DC motor M2 (403) is stopped at a step S530, whereby the transfer sheet is stopped at the pre-registration correcting portion 45. The time from after the transfer sheet has been stopped at the registration sensor 376 until it is re-fed is set in the registration-on timer. The registration stopping timer is adapted to measure the time until the leading end of the transfer sheet has passed the registration sensor 377 and arrives at the nip between the registration rollers 376.

Next, when at a step S531, the counting by the registration-on timer started at the step S526 is terminated, the DC motor M2 (403) is operated at a step S532 as required to thereby re-convey the transfer sheet.

Next, at a step S533, whether the judgement sensor flag for judging whether the detection of the delay and early arrival relative to the next transfer sheet by the judgement sensor 379 is to be effected is set is judged, and if it is set (the detection of the delay and early arrival is effected), the judgement timer for detecting the delay and early arrival of the next transfer sheet is started at a step S534, and the sheet feed control is terminated.

Here, the sheet feed control of the next transfer sheet is effected when the counting by the sheet supply timer started at the step S503 is terminated, and thereafter, the sheet feed control is repeatedly effected up to the transfer sheet for the last copying.

While in the above-described embodiment, the feed control of the transfer sheet in a digital copying machine is effected, the present invention is not restricted to a digital copying machine, but can also be provided for other page printers such as an analog copying machine, a color copying machine and a printer.

In the image forming apparatus of the present invention, the control means controls so that the sheet conveying speed may become higher in the order of the sheet feeding means, the image forming and conveying means and the sheet conveying means and therefore, the sheet is slowly and reliably supplied from the sheet supporting means, and is rapidly conveyed to the vicinity of the image forming means to thereby shorten the conveyance time, whereafter the sheet is slowly conveyed and an image can be reliably formed on the sheet by the image forming means, and the image forming apparatus can be made high in speed without changing the image forming process speed.

Further, the sheet conveying speed can be changed to thereby narrow the interval between the sheets fed to the image forming portion and enhance the image forming efficiency and productivity.

In the image forming apparatus of the present invention, the drive sources of the sheet feeding means, the sheet conveying means and the image forming and conveying means are made individual and therefore, the control of the sheet conveying speed of each means by the control means can be effected easily, and the image forming apparatus can be reliably made high in speed.

What is claimed is:

1. An image forming apparatus including:

image forming means for forming images on a sheet;

sheet supporting means for supporting the sheet;

sheet feeding means for feeding the sheet supported by said sheet supporting means;

first conveying means for conveying the sheet fed by said sheet feeding means;

second conveying means for conveying the sheet conveyed by said first conveying means to said image forming means to form the image by said image forming means; and control means for controlling a sheet conveying speed of each of said sheet feeding means, said first conveying means and said second conveying means, said control means performing control so that the sheet conveying speed of said first conveying means is faster than the sheet conveying speed of said second conveying means and so that the sheet conveying speed of said sheet feeding means is slower than the sheet conveying speed of said first conveying means, wherein said sheets are continously conveyed and when a succeeding sheet arrives early relative to a preceding sheet, said control means stops said first conveying means temporarily to delay the succeeding sheet.

2. An image forming apparatus according to claim 1, wherein the sheet conveying speed of said second conveying means is equal to the image forming process speed of said image forming means.

3. An image forming apparatus according to claim 1, wherein said sheet feeding means, said first conveying means and said second conveying means are respectively driven by different independent motors.

4. An image forming apparatus according to claim 3, wherein said control means temporarily stops the sheet when the sheet conveyed by said sheet feeding means reaches said first conveying means.

5. An image forming apparatus according to claim 4, wherein the sheet conveying speed of said first conveying means becomes faster than the sheet conveying speed of said second conveying means when feeding is restarted after the sheet is temporarily stopped.

6. An image forming apparatus according to claim 1, wherein said first conveying means is provided with registration rollers for registering the sheet by temporarily stopping sheet feeding.

7. An image forming apparatus according to claim 4, wherein said first conveying means is provided with a sensor for detecting the presence or absence of a sheet on a sheet conveying path at a side of said first conveying means in the direction of said image forming means, and wherein said control means stops said first conveying means when said sensor detects a leading end of the sheet.

8. An image forming apparatus according to claim 4, wherein said first conveying means temporarily stops sheet feeding to correct irregularity of a sheet feeding position of said sheet feeding means.

9. An image forming apparatus according to claim 1, wherein the sheet conveying speed of said second conveying means is faster than the sheet conveying speed of said sheet feeding means but slower than the sheet conveying speed of said first conveying means.

10. An image forming apparatus according to claim 1, wherein said first conveying means includes registration rollers for registering the sheet conveyed by said first conveying means and a registration detecting sensor by which said control means controls an operation of said registration rollers.

11. An image forming apparatus according to claim 1, wherein said control means judges an early arrival of the succeeding sheet on a basis of a count value of a judgement timer for detecting the early arrival or delay of the succeeding sheet relative to the preceding sheet.

12. An image forming apparatus according to claim 1 or 11, wherein when the sheets are continously conveyed and when the succeeding sheet arrives early relative to the preceding sheet, said control means stops said first conveying means temporarily to delay the succeeding sheet by just that much by which the succeeding sheet arrives early.

13. An image forming apparatus according to claim 1 or 11, wherein when the succeeding sheet is not judged to arrive early, said control means does not perform a stop of a conveyance of the succeeding sheet.

14. An image forming apparatus including:

image forming means for forming images on a sheet;

sheet supporting means for supporting the sheet;

sheet feeding means for feeding the sheet supported by said sheet supporting means;

first conveying means for conveying the sheet fed by said sheet feeding means;

second conveying means for conveying the sheet conveyed by said first conveying means to said image forming means to form the image by said image forming means; and control means for controlling said first conveying means, wherein when sheets are continously conveyed and when a succeeding sheet arrives early relative to a preceding sheet, said control means stops said first conveying means temporarily to delay the succeeding sheet.

15. An image forming apparatus according to claim 14, wherein said control means judges an early arrival of the succeeding sheet on a basis of a count value of a judgment timer for detecting the early arrival or delay of the succeeding sheet relative to the preceding sheet.

16. An image forming apparatus according to claim 14 or 15, wherein when sheets are continously conveyed and when a succeeding sheet arrives early relative to a preceding sheet, said control means stops said first conveying means temporarily to delay the succeeding sheet by just that much by which the succeeding sheet arrives early.

17. An image forming apparatus according to claim 14 or 15, wherein when the succeeding sheet is not judged to arrive early, said control means does not perform a stop of conveyance of the succeeding sheet.

18. An image forming apparatus according to claim 14 or 15, wherein said control means causes said first conveying means to abut a leading end of the sheet against said second conveying means, which is stopped, to warp the sheet.

19. An image forming apparatus according to claim 14 or 15, wherein said control means stops said first conveying means to stop the succeeding sheet, thereafter said control means restarts a conveyance of the succeeding sheet, and thereafter when the succeeding sheet arrives early relative to the preceding sheet, said control means stops said first conveying means temporarily to delay the succeeding sheet.

* * * * *

UNITED STATES PATENT AND TRADEMARK OFFICE

CERTIFICATE OF CORRECTION

PATENT NO. : 6,397,035 B2
DATED : May 28, 2002
INVENTOR(S) : Tatsuhito Kataoka et al.

It is certified that error appears in the above-identified patent and that said Letters Patent is hereby corrected as shown below:

Title page,
Item [57], ABSTRACT,
Line 8, “cable” should read -- capable --.

Drawings,
Sheet No. 4: Figure 4, “OVER RUN” should read -- OVERRUN --.

Column 6,
Line 49, “same,” should read -- same time, --.

Column 8,
Line 56, “sent” should read -- set --.

Column 11,
Line 1, “said” should read -- when --.
Line 54, “continously” should read -- continuously --.

Signed and Sealed this

Fifteenth Day of October, 2002

*Attest:*

*Attesting Officer*

JAMES E. ROGAN
*Director of the United States Patent and Trademark Office*